US006266826B1

(12) United States Patent
Alfano

(10) Patent No.: US 6,266,826 B1
(45) Date of Patent: Jul. 31, 2001

(54) PROTECTIVE HEAD DEVICE

(76) Inventor: Graciela G. Alfano, 20865 IH 10 W., San Antonio, TX (US) 78257

( * ) Notice: Subject to any disclaimer, the term of this patent is extended or adjusted under 35 U.S.C. 154(b) by 0 days.

(21) Appl. No.: 09/663,156

(22) Filed: Sep. 15, 2000

(51) Int. Cl.[7] ..... A42B 3/00
(52) U.S. Cl. ..... 2/411; 2/418; 2/425; 2/DIG. 11
(58) Field of Search ..... 2/411, 410, 412, 2/DIG. 11, 171, 425, 418

(56) References Cited

U.S. PATENT DOCUMENTS 2,391,335 * 12/1945 O'Brien .
4,698,852 * 10/1987 Romero ..... 2/171
4,856,116 * 8/1989 Sullivan ..... 2/DIG. 11 X
4,910,804 * 3/1990 Lidgren ..... 2/DIG. 11 X
5,337,420 * 8/1994 Haysom et al. ..... 2/410
5,875,488 * 3/1999 Milani ..... 2/171 X
5,946,734 * 9/1999 Vogan ..... 2/412
5,963,989 * 10/1999 Robertson ..... 2/411
6,000,062 * 12/1999 Trakh ..... 2/171

* cited by examiner

*Primary Examiner*—Rodney M. Lindsey

(57) ABSTRACT

A protective head device for protecting the forehead, temporal, and occipital portions of a user's head. The protective head device includes an elongated member. The elongated member includes a first end, a second end, a front side, a back side and a peripheral edge extending between the front and back sides. The elongated member comprises a resiliently flexible material. There is also a securing means for selectively coupling the first end and the second end of the elongated member.

10 Claims, 2 Drawing Sheets

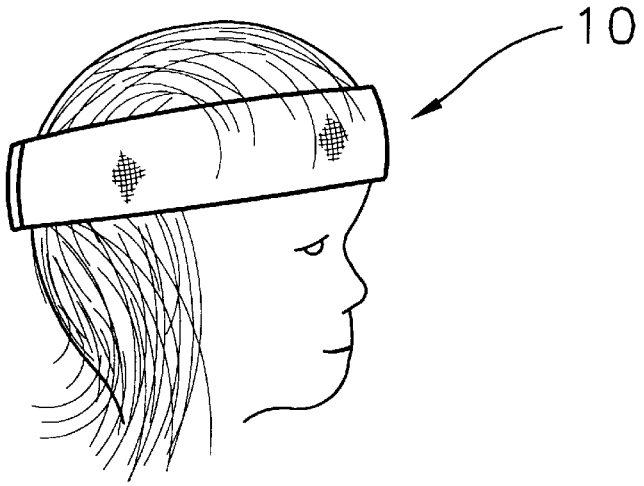
FIG. 1
FIG. 2
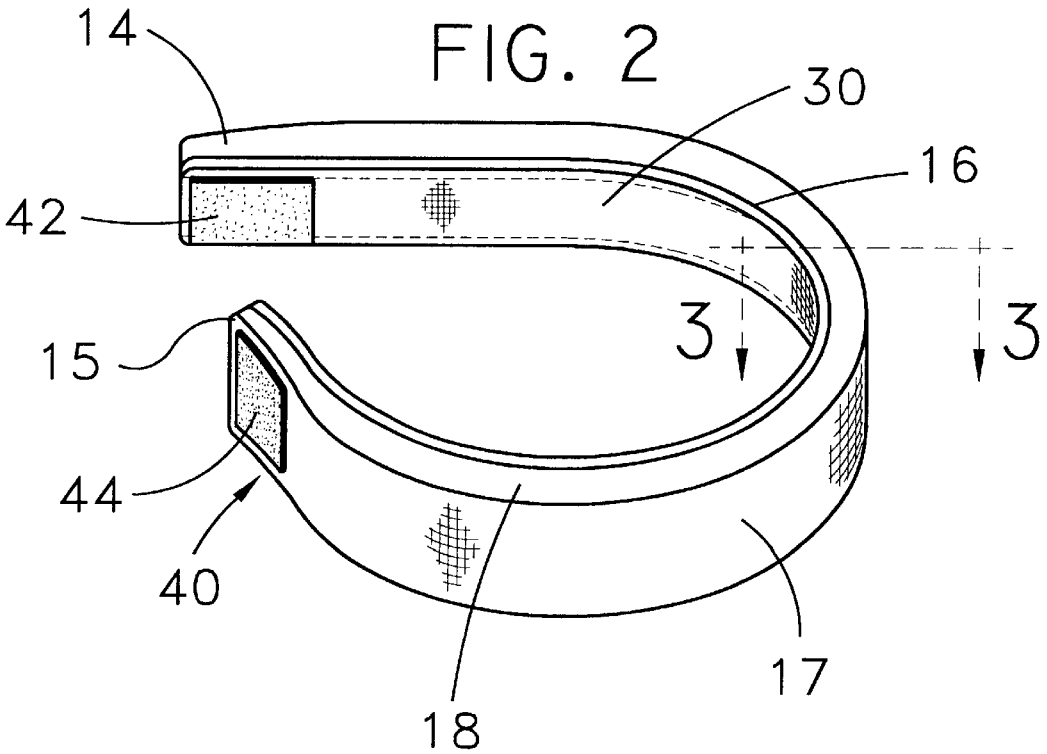

PROTECTIVE HEAD DEVICE

BACKGROUND OF THE INVENTION

1. Field of the Invention

The present invention relates to protective head devices and more particularly pertains to a new protective head device for protecting the forehead, temporal, and occipital portions of a user's head.

2. Description of the Prior Art

The use of protective head devices is known in the prior art. More specifically, protective head devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,546,842; U.S. Pat. No. 4,581,773; U.S. Pat. No. 5,075,903; U.S. Pat. No. 5,615,419; U.S. Pat. No. 5,768,715; U.S. Pat. No. 4,581,773; and U.S. Pat. No. Des. 379,028.

While these devices fulfill their respective, particular objectives and requirements, the aforementioned patents do not disclose a new protective head device. The inventive device includes a protective head device for protecting the forehead, temporal, and occipital portions of a user's head from injury. The protective head device comprising an elongated member. The elongated member includes a first end, a second end, a front side, a back side and a peripheral edge extending between the front and back sides. The elongated member comprises a resiliently flexible material. There is also a securing means for selectively coupling the first end and the second end of the elongated member.

In these respects, the protective head device according to the present invention substantially departs from the conventional concepts and designs of the prior art, and in so doing provides an apparatus primarily developed for the purpose of protecting the forehead, temporal, and occipital portions of a user's head.

SUMMARY OF THE INVENTION

In view of the foregoing disadvantages inherent in the known types of protective head devices now present in the prior art, the present invention provides a new protective head device construction wherein the same can be utilized for protecting the forehead, temporal, and occipital portions of a user's head.

The general purpose of the present invention, which will be described subsequently in greater detail, is to provide a new protective head device apparatus and method which has many of the advantages of the protective head devices mentioned heretofore and many novel features that result in a new protective head device which is not anticipated, rendered obvious, suggested, or even implied by any of the prior art protective head devices, either alone or in any combination thereof.

To attain this, the present invention generally comprises an elongated member. The elongated member includes a first end, a second end, a front side, a back side and a peripheral edge extending between the front and back sides. The elongated member comprises a resiliently flexible material. There is also a securing means for selectively coupling the first end and the second end of the elongated member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective head device apparatus and method which has many of the advantages of the protective head devices mentioned heretofore and many novel features that result in a new protective head device which is not anticipated, rendered obvious, suggested, or even implied by any of the prior art protective head devices, either alone or in any combination thereof.

It is another object of the present invention to provide a new protective head device which may be easily and efficiently manufactured and marketed.

It is a further object of the present invention to provide a new protective head device which is of a durable and reliable construction.

An even further object of the present invention is to provide a new protective head device which is susceptible of a low cost of manufacture with regard to both materials and labor, and which accordingly is then susceptible of low prices of sale to the consuming public, thereby making such protective head device economically available to the buying public.

Still yet another object of the present invention is to provide a new protective head device which provides in the apparatuses and methods of the prior art some of the advantages thereof, while simultaneously overcoming some of the disadvantages normally associated therewith.

Still another object of the present invention is to provide a new protective head device for protecting the forehead, temporal, and occipital portions of a user's head.

Yet another object of the present invention is to provide a new protective head device which includes an elongated member. The elongated member includes a first end, a second end, a front side, a back side and a peripheral edge extending between the front and back sides. The elongated member comprises a resiliently flexible material. There is also a securing means for selectively coupling the first end and the second end of the elongated member.

Still yet another object of the present invention is to provide a new protective head device that is lightweight an easily worn by a user.

Even still another object of the present invention is to provide a new protective head device that is washable.

An even further object of the present invention is that it is easily put on or removed from a users head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new protective head device according to the present invention.

FIG. 2 is a schematic perspective view of the present invention showing the securing means and cotton liner.

DESCRIPTION OF THE PREFERRED EMBODIMENT

Figure 3:
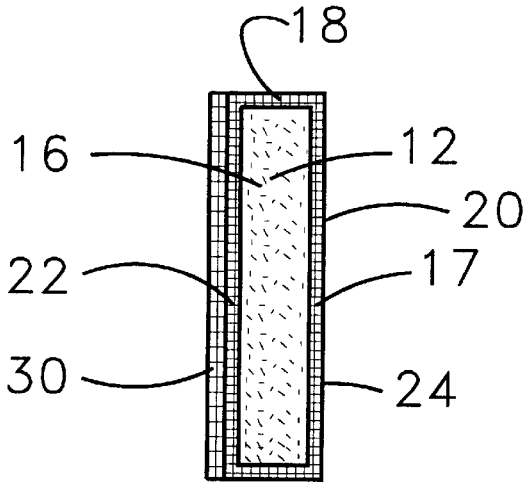
FIG. 3 is a schematic cross-sectional view of the present invention taken along lines 3—3.
Figure 4:
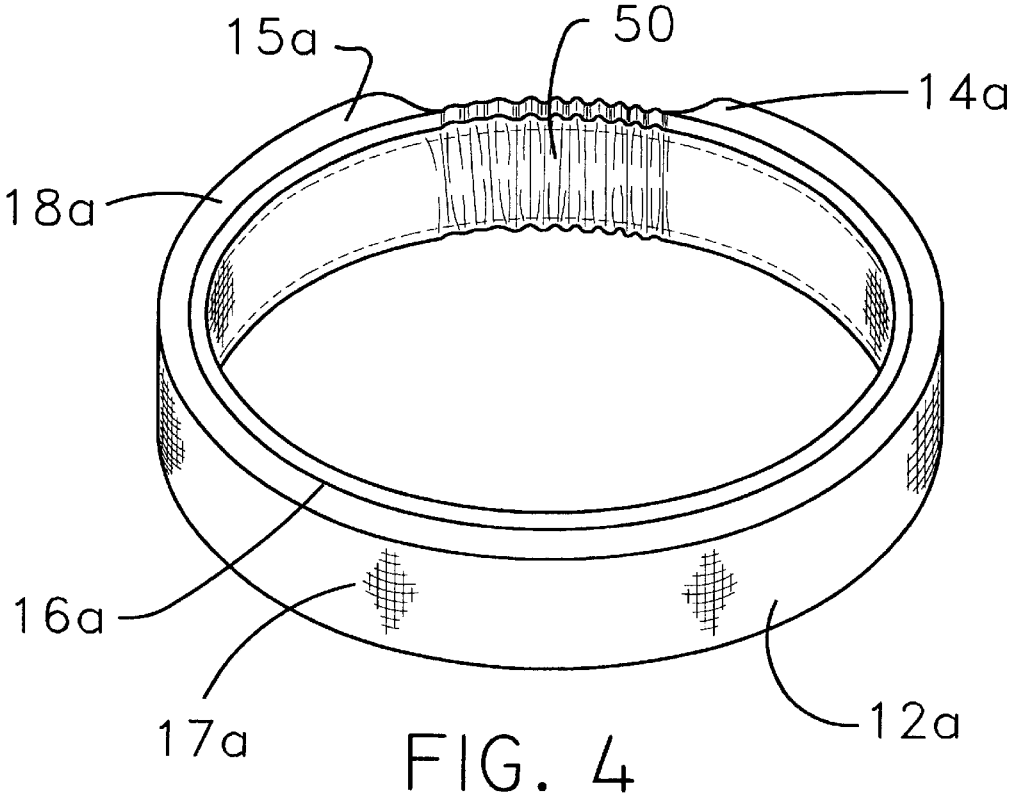
FIG. 4 is a schematic perspective view of the present invention showing an embodiment having an elastic securing means.

With reference now to the drawings, and in particular to FIGS. 1 through 4 thereof, a new protective head device embodying the principles and concepts of the present invention and generally designated by the reference numeral 10 will be described.

As best illustrated in FIGS. 1 through 4, the protective head device 10 generally comprises an elongated member 12. The elongated member 12 has a first end 14, a second end 15, a front side 16, a back side 17 and a peripheral edge 18 extending between the front side 16 and back side 17. The elongated member 12 comprises a resiliently flexible material. The elongated member 12 may be made of such materials as foam, rubber, or any other resiliently flexible material.

It is also possible to have a sleeve member 20 around the elongated member. The sleeve member has a shape and size adapted for receiving the elongated member 12. The elongated member 12 is positioned within the sleeve member 20 such that a front side 22 and a back side 24 of the sleeve member 20 are defined. The sleeve member 20 comprises a cloth material. However, the sleeve member 20 may also be comprised of synthetic fabrics as well. To make the elongated member 12 more attractive a wide variety of patterns of the sleeve member 20 may be used.

The front side 22 of the sleeve member 20 generally has a covering member 30. The covering member 30 generally covers and is securably attached to the front side 22 of the sleeve member 20. The covering member 30 comprises a cotton material. However, other materials may also be used such as synthetic fabrics.

There is also a securing means 40 for selectively coupling the first end 14 and the second end 15 of the elongated member 12. The securing means 40 comprises a hook and loop means. The hook and loop means comprises a hook portion 42. The hook portion 42 is coupled to the covering member 30 and is positioned near the first end 14 of the elongated member 12. The loop portion 44 is coupled to the front side 22 of the sleeve member 20 and positioned nearer the second end 15 of the elongated member 12. In an embodiment, the hook portion 42 selectively couples to the loop portion 44, thereby releasably coupling the first end 14 and second end 15 of the elongated member 12. Other securing means may also be used. The first and second ends of the elongated member may be secured by rope, twine, pins, buttons, or any other fastening means that will couple the first end 14 and second end 15 of the elongated member 12.

Another embodiment has an elongated member 12*a*. The elongated member 12*a* includes a first end 14*a*, a second end 15*a*, a front side 16*a*, a back side 17*a* and a peripheral edge 18*a* extending between the front side 16*a* and back side 17*a*. The elongated member 12*a* comprises a resiliently flexible material.

There is also a panel 50 extending between and coupling the first end 14*a* and the second end 15*a* of the elongated member 12*a*. The panel 50 may comprise an elastomeric material, a cotton or synthetic fabric.

In use, the user or another individual places the elongated member 12 around the user's head. If there is a covering member 30 attached to the elongated member 12 it is generally placed against the user's head. Once the elongated member 12 is placed around the user's head the first end 14 and second end 15 are securably coupled by the securing means 40 or any other fastening means.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective head device for protecting the forehead, temporal, and occipital portions of a user's head from injury, said protective head device comprising:

a covering member for positioning against the user's head, the covering member comprising a continuous loop for mounting about the user's head, an adjustment portion of the continuous loop of the covering member being elastomeric for permitting stretching of the adjustment portion of the continuous loop to adjust an overall circumferential size of the continuous loop to a size of the user's head;

a resiliently flexible elongated member mounted on the covering member for absorbing impacts directed toward the user's head, the elongated member having a first end, a second end, a front side, and a back side, the elongated member extending along and being mounted on only the remainder portion of the continuous loop of the covering member such that the elongated member does not extend along the adjustment portion of the continuous loop.

2. The protective head device for protecting the forehead, temporal, and occipital portions of a user's head from injury of claim 1, wherein the adjustment portion has opposite margins spaced along a longitudinal axis of the adjustment portion, the covering member comprises the adjustment portion and a remainder portion extending between the opposite margins of the adjustment portion, wherein a longitudinal extent of the adjustment portion equals approximately 15 percent of a longitudinal extent of the remainder portion of the covering member.

3. The protective head device for protecting the forehead, temporal, and occipital portions of a user's head from injury of claim 1, wherein the covering member comprises a cloth material.

4. The protective head device for protecting the forehead, temporal, and occipital portions of a user's head from injury of claim 1, further comprising:

a sleeve member having a shape and size adapted for receiving the elongated member, the elongated member being positioned in the sleeve member.

5. A protective head device for protecting the forehead, temporal, and occipital portions of a user's head from injury of claim 4, wherein the sleeve member comprises a cloth material.

6. The protective head device for protecting the forehead, temporal, and occipital portions of a user's head from injury of claim 1, wherein the covering member comprises a cotton material.

7. The protective head device for protecting the forehead, temporal, and occipital portions of a user's head from injury of claim 1, wherein the elongated member has a thickness between the front side and back side of the elongated member, the elongated member having end portions, and wherein the thickness of the end portions of the elongated member is tapered toward the adjustment portion of the continuous loop of the covering member.

8. The protective head device for protecting the forehead, temporal, and occipital portions of a user's head from injury of claim 1, wherein the elongated member has a width between an upper peripheral edge and a lower peripheral edge of the elongated member, and wherein the width of the elongated member is uniform between end portion of the elongated member to provide uniform impact protection along the elongated member between the end portions.

9. A protective head device for protecting the forehead, temporal, and occipital portions of a user's head from injury, said protective head device comprising:

a covering member for positioning against the user's head, the covering member comprising a continuous loop for mounting about the user's head, an adjustment portion of the continuous loop of the covering member being elastomeric for permitting stretching of the adjustment portion of the continuous loop to adjust an overall circumferential size of the continuous loop to a size of the user's head;

a resiliently flexible elongated member mounted on the covering member for absorbing impacts directed toward the user's head, the elongated member having a first end, a second end, a front side, and a back side, the elongated member extending along and being mounted on only the remainder portion of the continuous loop of the covering member such that the elongated member does not extend along the adjustment portion of the continuous loop;

a sleeve member having a shape and size adapted for receiving the elongated member, the elongated member being positioned in the sleeve member;

wherein the adjustment portion has opposite margins spaced along a longitudinal axis of the adjustment portion, the covering member comprises the adjustment portion and a remainder portion extending between the opposite margins of the adjustment portion, wherein a longitudinal extent of the adjustment portion equals approximately 15 percent of a longitudinal extent of the remainder portion of the covering member;

wherein the elongated member has a thickness between the front side and back side of the elongated member, the elongated member having end portions, and wherein the thickness of the end portions of the elongated member is tapered toward the adjustment portion of the continuous loop of the covering member; and wherein the elongated member has a width between an upper peripheral edge and a lower peripheral edge of the elongated member, and wherein the width of the elongated member is uniform between end portion of the elongated member to provide uniform impact protection along the elongated member between the end portions.

10. The protective head device for protecting the forehead, temporal, and occipital portions of a user's head from injury of claim 9, wherein the covering member comprises a cloth material, the sleeve member comprises a cloth material, and the covering member comprises a cotton material.

* * * * *